US010787907B2

(12) United States Patent
Tsuruta et al.

(10) Patent No.: US 10,787,907 B2
(45) Date of Patent: Sep. 29, 2020

(54) TURBINE AND TURBINE SYSTEM

(71) Applicant: TOSHIBA ENERGY SYSTEMS & SOLUTIONS CORPORATION, Kawasaki-shi (JP)

(72) Inventors: Kazutaka Tsuruta, Yokohama (JP); Hideyuki Maeda, Yokohama (JP)

(73) Assignee: TOSHIBA ENERGY SYSTEMS & SOLUTIONS CORPORATION, Kawasaki-shi (JP)

( * ) Notice: Subject to any disclaimer, the term of this patent is extended or adjusted under 35 U.S.C. 154(b) by 0 days.

(21) Appl. No.: 16/437,434

(22) Filed: Jun. 11, 2019

(65) Prior Publication Data

US 2019/0323351 A1 Oct. 24, 2019

Related U.S. Application Data

(63) Continuation of application No. PCT/JP2016/086931, filed on Dec. 12, 2016.

(51) Int. Cl.
*F01D 3/04* (2006.01)

(52) U.S. Cl.
CPC ..... *F01D 3/04* (2013.01)

(58) Field of Classification Search
CPC ..... F01D 3/04; F01D 11/001; F01D 11/04; F01D 25/00; F01D 25/16; F05D 2220/31; F05D 2240/55; F05D 2260/15
See application file for complete search history.

(56) References Cited

U.S. PATENT DOCUMENTS 3,614,255 A 10/1971 Rooney
6,443,690 B1 * 9/2002 Zabrecky ..... F01D 3/04 415/107

(Continued)

FOREIGN PATENT DOCUMENTS

GB 374783 6/1932
JP 5-59901 3/1993

(Continued)

OTHER PUBLICATIONS

International Search Report dated Feb. 28, 2017 in PCT/JP2016/086931 filed Dec. 12, 2016 (with English Translation).

(Continued)

*Primary Examiner* — Igor Kershteyn
(74) *Attorney, Agent, or Firm* — Oblon, McClelland, Maier & Neustadt, L.L.P.

(57) ABSTRACT

A turbine which has: a balance piston disposed in a turbine rotor; a plurality of balance piston seals disposed on a casing side in a manner to face the balance piston; a balance piston extraction hole allowing extraction from between the plurality of balance piston seals to a middle stage of the turbine stages; an exhaust connection piping connecting a low pressure side of the balance piston to a turbine exhaust system; a exhaust connection piping valve mechanism which is provided in the exhaust connection piping; a plurality of seal mechanisms provided between the low pressure side of the balance piston and the atmosphere; and an exhaust piping allowing exhaust from between the plurality of seal mechanisms.

8 Claims, 5 Drawing Sheets

(56) References Cited

U.S. PATENT DOCUMENTS

| | | | | |
|---|---|---|---|---|
| 6,705,086 | B1 * | 3/2004 | Retzlaff | F01D 3/00 60/653 |
| 8,425,180 | B2 * | 4/2013 | Sears | F01K 23/16 415/107 |
| 9,488,051 | B2 * | 11/2016 | Maeda | F01D 25/26 |
| 2005/0076645 | A1 * | 4/2005 | Frutschi | F01K 21/042 60/772 |
| 2007/0199300 | A1 * | 8/2007 | MacAdam | F01K 17/025 60/39.52 |
| 2014/0023478 | A1 | 1/2014 | Maeda et al. | |

FOREIGN PATENT DOCUMENTS

| | | |
|---|---|---|
| JP | 2890907 B2 | 5/1999 |
| JP | 2014-20325 | 2/2014 |
| JP | 2014-20330 | 2/2014 |

OTHER PUBLICATIONS

Written Opinion dated Feb. 28, 2017 in PCT/JP2016/086931 filed Dec. 12, 2016.

* cited by examiner

TURBINE AND TURBINE SYSTEM

CROSS REFERENCE TO RELATED APPLICATION

The present application is a continuation application of International Application No. PCT/JP2016/086931, filed Dec. 12, 2016. The contents of this application are incorporated herein by reference in their entirety.

FIELD

Embodiments of the present invention relate to a turbine and a turbine system.

BACKGROUND

For example, in a turbine used for a power generation plant or the like, when the turbine is expanded in one direction, a thrust force is generated in a turbine shaft by a pressure difference occurring between an entrance side and an exit side of the turbine.

The thrust force generated in the turbine shaft is supported by a thrust bearing. In a case of a large thrust force, the thrust bearing is to be formed large, leading to a problem of a cost increase and so on. Further, forming the thrust bearing large is limited in view of circumferential speed, resulting also in a problem that design cannot be done.

As a method for making a thrust force small, there is suggested a method of generating a counter thrust force by providing a balance piston using a shaft seal structure of a turbine.

The aforementioned turbine in which the thrust force is made small by providing the balance piston might have a following problem.

For example, when a gland seal which performs sealing between the inside and the outside (atmosphere) of a casing is constituted by a plurality of labyrinth seals, in order to prevent leakage of $CO_2$ or the like, suction from a space between these labyrinth seals is sometimes performed by a gland pump to control the space to have a negative pressure. Besides, a structure is considered in which an exhaust connection piping that connects a low pressure side of a balance piston and a turbine exhaust line is provided and also a balance piston extraction hole is provided in the middle of the balance piston, to thereby allow $CO_2$ (at low temperature and high pressure) for cooling or sealing to be extracted and converged in a middle stage of the turbine. In a case of the above configuration, the following problem occurs.

That is, in the turbine at the time of low load, pressure drawdown occurs in the front stage, and because of lowness of an original pressure, the pressure drawdown in the front stage reduces the pressure, so that pressure drawdown hardly occurs in the rear stage. In other words, a degree of pressure drawdown in the rear stage becomes smaller compared with that in the front stage, resulting in a smaller pressure difference in the rear stage. Therefore, at the time of low load, in the turbine of the above configuration, the pressure at a portion of the balance piston extraction hole communicating to the middle stage of the turbine is reduced, resulting in the smaller difference in relation to a low pressure side pressure of the balance piston. Thereby, a flow of $CO_2$ from the high pressure side to the low pressure side of the balance piston is decreased. Meanwhile, a suction force by the gland pump acts on a space on the low pressure side of the balance piston, so that a backflow of exhaust gas at high temperature might occur from the turbine exhaust line into the exhaust connection piping.

The problem to be solved by the present invention is to provide a turbine and a turbine system which can prevent occurrence of a backflow of exhaust gas at high temperature into an exhaust connection piping at the time of low load.

DETAILED DESCRIPTION

A turbine of an embodiment has: a casing; a turbine rotor disposed to penetrate the casing; a plurality of turbine stages disposed in the casing and provided along a shaft direction of the turbine rotor; a working fluid injection pipe allowing a working medium to be injected into the casing and to be distributed from the front stage toward the rear stage of the turbine stages, thereby rotating the turbine rotor; a balance piston disposed in the turbine rotor; a plurality of balance piston seals disposed on a casing side in a manner to face the balance piston; a balance piston extraction hole allowing extraction from between the plurality of balance piston seals to the middle stage of the turbine stages; an exhaust connection piping connecting a low pressure side of the balance piston to a turbine exhaust system; an exhaust connection piping valve mechanism provided in the exhaust connection piping; a plurality of seal mechanisms provided between the low pressure side of the balance piston and the atmosphere; and an exhaust piping allowing exhaust from between the plurality of seal mechanisms.

Figure 1:
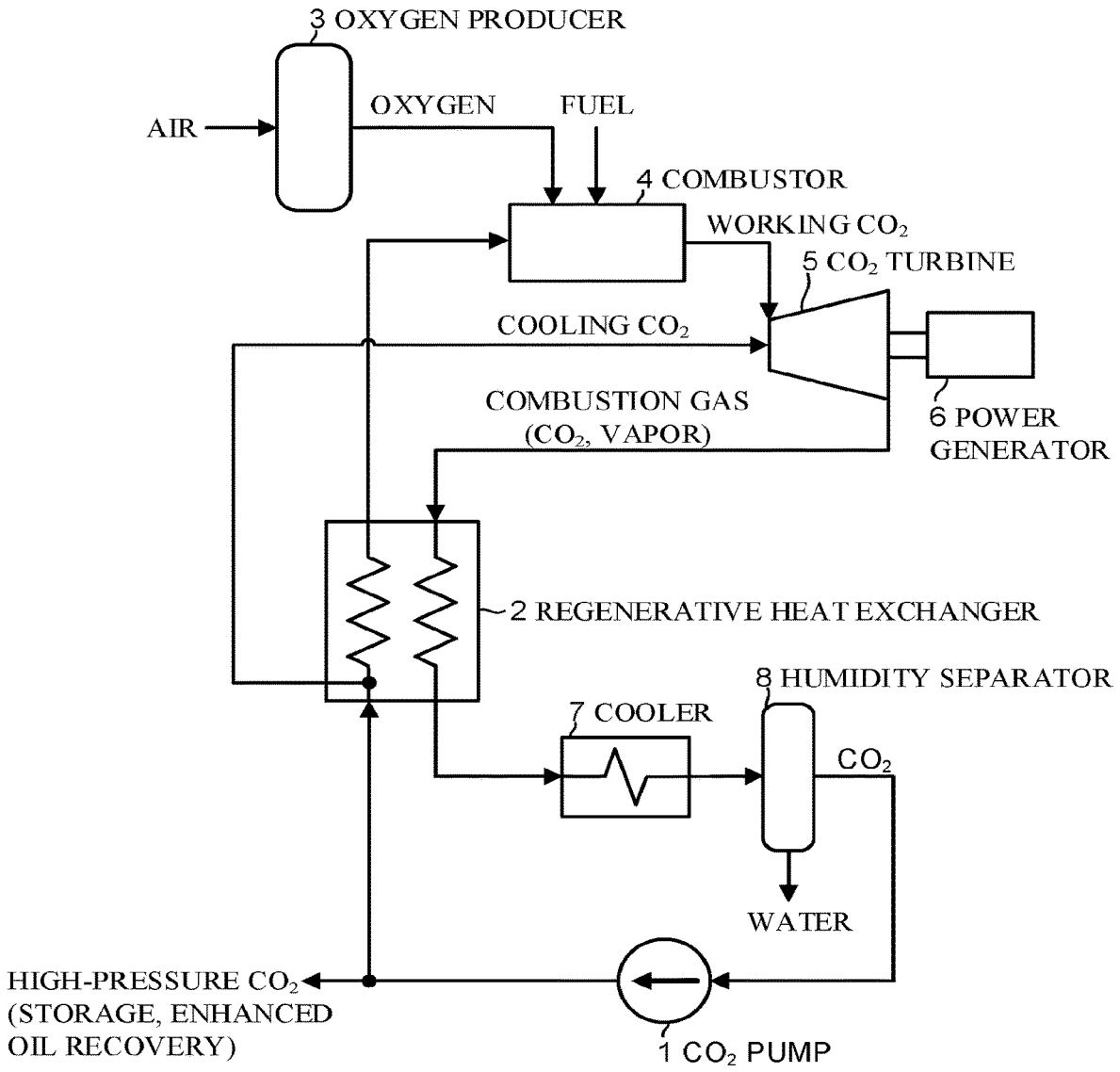
FIG. 1 is a system diagram of a thermal power generation system provided with a turbine of an embodiment.

Hereinafter, embodiments will be described with reference to the drawings. FIG. 1 is a system diagram of a thermal power generation system provided with a turbine of an embodiment.

As illustrated in FIG. 1, the thermal power generation system of this embodiment has a $CO_2$ pump 1, a regenerative heat exchanger 2, an oxygen producer 3, a combustor 4, a $CO_2$ turbine 5, a power generator 6, a cooler 7, a humidity separator 8 and so on. $CO_2$ indicates carbon dioxide.

The $CO_2$ pump 1 compresses highly-pure $CO_2$ made by separating water from combustion gas ($CO_2$ and vapor) by the humidity separator 8, and supplies the $CO_2$ at high pressure to the combustor 4 and the $CO_2$ turbine 5 in a branching manner through the regenerative heat exchanger 2.

Note that the highly-pure $CO_2$ at high pressure generated in the $CO_2$ pump 1 may be stored or utilized for enhanced oil recovery. The one $CO_2$ pump 1 doubles as supply sources for $CO_2$ for working (hereinafter, referred to as "working $CO_2$") and $CO_2$ for cooling (hereinafter, referred to as "cooling $CO_2$). The working $CO_2$ may be called working gas or working fluid, and the cooling $CO_2$ may be called cooling gas or cooling fluid.

The regenerative heat exchanger 2 supplies $CO_2$ increased in temperature by heat exchange to the combustor 4 and the $CO_2$ turbine 5. $CO_2$ supplied to the combustor 4 is for working. $CO_2$ supplied to the $CO_2$ turbine 5 is for cooling or sealing. Further, the regenerative heat exchanger 2 cools through heat exchange the combustion gas ($CO_2$ and vapor) discharged from the $CO_2$ turbine 5.

The oxygen producer 3 produces oxygen and supplies the produced oxygen to the combustor 4. The combustor 4 combusts injected natural gas such as methane gas, $CO_2$ and oxygen to generate combustion gas ($CO_2$ and vapor) at high temperature and high pressure, and supplies the combustion gas to the $CO_2$ turbine 5 as the working $CO_2$.

The $CO_2$ turbine 5 rotates rotor blades 13 (see FIG. 2) in the turbine and a turbine rotor 11 supporting the rotor blades 13 by the working $CO_2$ at high temperature and high pressure, and transmits their rotation force to the power generator 6.

In other words, the $CO_2$ turbine 5 is a turbine which uses $CO_2$ supplied from the one $CO_2$ pump 1 mainly as the working medium (working fluid) for rotating the turbine rotor 11 and a medium for cooling (cooling gas).

The power generator 6 generates power by a rotation force of an axle of the $CO_2$ turbine 5. A combination of the $CO_2$ turbine 5 and the power generator 6 may be sometimes called a $CO_2$ turbine power generator. The cooler 7 further cools the combustion gas ($CO_2$ and vapor) having passed through the regenerative heat exchanger 2, and the cooled combustion gas ($CO_2$ and vapor) is sent to the humidity separator 8.

The humidity separator 8 separates water from the combustion gas ($CO_2$ and vapor) at low temperature sent from the cooler 7, and returns highly-pure $CO_2$ back to the $CO_2$ pump 1.

The thermal power generation system is constituted by a circulation system of oxygen combustion using $CO_2$ at supercritical pressure and is a zero emission power generation system which is capable of effectively utilizing $CO_2$ without discharging NOR. Use of this system makes it possible to recover and recycle the highly-pure $CO_2$ at high pressure without separately installing facilities for separating and recovering $CO_2$.

In the case of this thermal power generation system, power is generated by rotating (the rotor blades of) the $CO_2$ turbine 5 by the $CO_2$ at high temperature (working $CO_2$) generated by injecting and combusting $CO_2$, natural gas and oxygen.

Then, the combustion gas ($CO_2$ and vapor) discharged from the $CO_2$ turbine 5 is cooled through the regenerative heat exchanger 2 and the cooler 7 and has water therein separated in the humidity separator 8, and thereafter, the $CO_2$ gas is circulated back to the $CO_2$ pump 1 and compressed. In this system, most of $CO_2$ being circulated to the combustor 4, $CO_2$ generated by combustion can be recovered as it is.

First Embodiment

Next, a turbine and a turbine system according to a first embodiment will be described with reference to FIG. 2.

Figure 2:
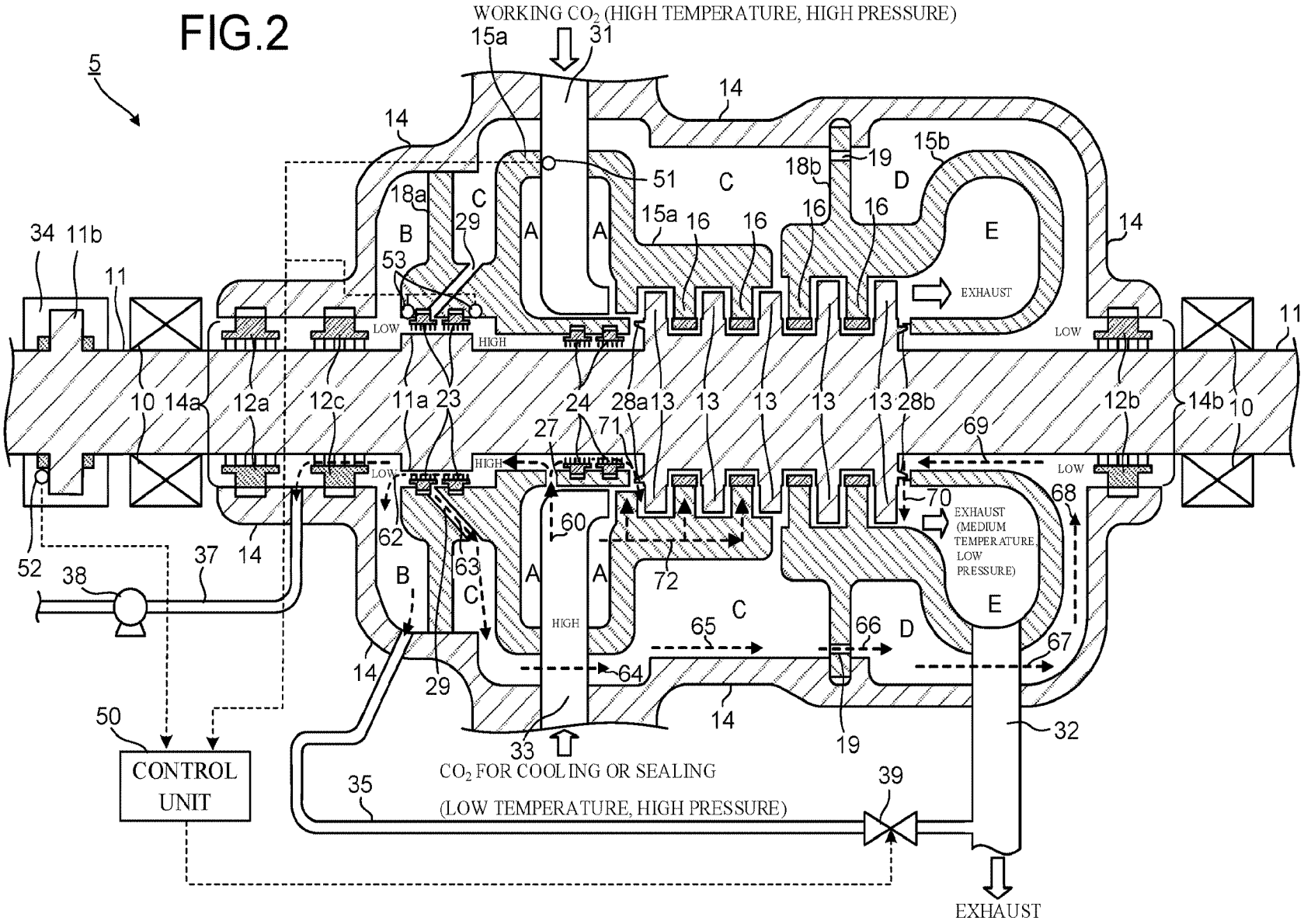
FIG. 2 is a diagram schematically illustrating a configuration of a first embodiment.

As illustrated in FIG. 2, a $CO_2$ turbine 5 of the first embodiment has a bearing 10, a turbine rotor 11, a balance piston 11*a*, a flange portion 11*b*, labyrinth seals 12*a*, 12*b*, 12*c* (seal mechanisms), a rotor blade 13, an outer casing 14, inner casings 15*a*, 15*b*, a stationary blade 16, partition walls 18*a*, 18*b*, a partition wall hole 19, a balance piston seal 23, a labyrinth seal 24, a hole 27, wheel space seals 28*a*, 28*b*, a balance piston extraction hole 29, a working $CO_2$ injection pipe 31 (a working fluid injection pipe), a $CO_2$ discharge pipe 32 (a turbine exhaust system), a $CO_2$ injection pipe for cooling or sealing 33 (hereinafter, referred to as a "cooling $CO_2$ injection pipe 33"), a thrust bearing 34, an exhaust connection piping 35, an exhaust piping 37, a gland pump 38, a regulating valve 39 (an exhaust connection piping valve mechanism), a control unit 50, pressure sensors 51, 53, a load cell 52 (a thrust load detection sensor) and so on. Note that "high" in the drawing indicates a high pressure while "low" indicates a low pressure.

The bearing 10 rotatably supports shaft ends on both sides of the turbine rotor 11. Further, the thrust bearing 34 rotatably supports the shaft end on one side of the turbine rotor 11, and receives a thrust force by supporting the flange portion 11*b* provided in the turbine rotor 11. The turbine rotor 11 has, in almost a center thereof, a plurality of moving blades 13 implanted in a circumferential direction. Besides, the turbine rotor 11 is provided with the balance piston 11*a*.

In an inner periphery of the inner casing 15*a* which faces the balance piston 11*a*, the balance piston seal 23 of a labyrinth structure is provided. The balance piston seal 23 suppresses a flow of $CO_2$ by a plurality of fins to thereby decrease a pressure. A pressure difference occurs between a right side and a left side of a clearance where the balance piston seal 23 is disposed in FIG. 2. In this example, the pressure on the right side of the balance piston seal is high and indicated as "high" while the pressure on the left side is low and indicated as "low".

The balance piston seal 23 generates a pressure difference between a space divided by the balance piston seal 23 (a clearance portion continuing into a cooling chamber A and a cooling chamber B), to thereby generate a counter thrust force acting from the right side to the left side in FIG. 2. The counter thrust force decreases a thrust load in a shaft direction of the turbine rotor 11.

In an inner periphery of the inner casing 15*a* which is inner side (right side in FIG. 2) than a position of the balance piston 11*a*, the labyrinth seal 24 of a labyrinth structure is provided. The labyrinth seal 24 adjusts $CO_2$ for cooling or sealing to have a proper pressure and supplies it to the wheel space seal 28*a*, thereby performing sealing so as not to let the working $CO_2$ leak to a casing side at a minimum flow amount.

The outer casing 14 forms a shell of a turbine main body and has through holes 14*a*, 14*b* in both ends in the shaft direction. In a gap between the through hole 14*a* and the turbine rotor 11, the labyrinth seals 12*a*, 12*c* are disposed. In a gap between the through hole 14*b* and the turbine rotor 11, the labyrinth seal 12*b* is disposed.

The labyrinth seals 12*a*, 12*b*, 12*c* constitute the gland seal which seals a clearance between the turbine rotor 11 penetrating the through holes 14*a*, 14*b* of the outer casing 14 and openings of the through holes 14*a*, 14*b* in a manner that the turbine rotor 11 can rotate. Further, the exhaust piping 37 is connected between the labyrinth seal 12*a* and the labyrinth seal 12*c*. The exhaust piping 37 is provided with the gland pump 38.

The labyrinth seals 12*a*, 12*b*, 12*c* perform sealing in a manner that the turbine rotor 11 can rotate and expose end portions of the turbine rotor 11 to the outside of the outer casing 14. This reduces leakage of the cooling $CO_2$ to the outside between the outer casing 14 and the turbine rotor 11. Further, suction by the exhaust piping 37 from between the labyrinth seal 12*a* and the labyrinth seal 12*c* makes a space therebetween have a negative pressure, thereby further reducing leakage of the cooling $CO_2$ to the outside.

The inner casings 15*a*, 15*b* are provided in a bent form so as to form the cooling chamber A and an exhaust chamber E between the turbine rotor 11 and the inner casings 15*a*, 15*b*.

The inner casings 15*a*, 15*b* and the outer casing 14 provided outside them constitute a double casing structure. Here, the double casing structure is exemplified, but the casing may be a single casing with one layer.

The inner casings 15*a*, 15*b* are provided with the stationary blades 16 in a manner to nest with the rotor blades 13 on the turbine rotor 11 side. One set of the rotor blade 13 and the stationary blade 16 is called a turbine stage, the one closest to the working $CO_2$ injection pipe 31 being called the first stage, the one second closest being called the second stage, and so on. The turbine stage close to the working $CO_2$ injection pipe 31 is the front stage, the turbine stage far from it is the rear stage, and the turbine stage in the middle thereof is the middle stage.

Further, the partition walls 18*a*, 18*b* are provided between the inner casings 15*a*, 15*b* and the outer casing 14, and these partition walls 18*a*, 18*b* form cooling chambers B, C, D between the inner casings 15*a*, 15*b* and the outer casing 14.

The casing structure provided with the outer casing 14 and the inner casings 15*a*, 15*b* has the cooling chamber A into which $CO_2$ for cooling the turbine or for sealing is injected at a predetermined temperature and a predetermined pressure, and the cooling chambers B, C, D into which the cooling $CO_2$ is injected at a pressure reduced from the pressure of the cooling chamber A.

The cooling $CO_2$ at high pressure injected into the cooling $CO_2$ injection pipe 33 flows in the cooling chambers A, B, C, D. Hereinafter, a flow, a temperature and a pressure of the cooling $CO_2$ at the time of rated output will be described. The sequence of dotted-line arrows 60 to 70 is the flow of the cooling $CO_2$ which cools the casing portion. The cooling $CO_2$ made to have a lower pressure at the portion of the balance piston seal 23 flows branching out into the cooling chamber B and the cooling chamber C. The pressure of the cooling $CO_2$ gradually decreases in the above flow.

Other than the above, as flow paths of the cooling $CO_2$, there are flows to cool or seal the turbine which are indicated by dotted-line arrows 71, 72. For example, the flow path of the arrow 72 is a cylindrical flow path provided inside the inner casings 15*a*, 15*b* and is to cool the stationary blade 16.

In the cooling chamber B on the low pressure side of the balance piston 11*a*, there is disposed the exhaust connection piping 35 connecting the cooling chamber B and the $CO_2$ discharge pipe 32 being a turbine discharge system. The exhaust connection piping 35 is provided with the regulating valve 39 as a exhaust connection piping valve mechanism. The exhaust connection piping 35 allows part of the cooling $CO_2$ which flows from the high pressure side of the balance piston 11*a* into the cooling chamber B being the low pressure side to be discharged to the $CO_2$ discharge pipe 32 at the time of rated output and so on.

Here, each of the cooling chambers A to D and the exhaust chamber E will be described. Into the cooling chamber A is injected the cooling $CO_2$ from the cooling $CO_2$ injection pipe 33. The cooling $CO_2$ injected into the cooling chamber A is set at a temperature to properly cool turbine components which becomes to have a high temperature.

The pressure of the cooling chamber A is kept slightly higher than the pressure inside the working $CO_2$ injection pipe 31 for the purpose of preventing a backflow of the working $CO_2$ at high temperature.

Into the cooling chamber B, the cooling $CO_2$ subjected to pressure reduction at the balance piston seal 23 is injected from the cooling chamber A through the hole 27. The cooling chamber B is a space for decreasing influence of the temperature and pressure which the labyrinth seals 12*a*, 12*c* receive.

The temperature of the cooling chamber B is almost the same as the temperature of the cooling chamber A. The pressure of the cooling chamber B is substantially reduced from that of the cooling chamber A by the balance piston seal 23, to become almost the same pressure as that of the cooling chamber D (low pressure of about 1/10 of the pressure inside the working $CO_2$ injection pipe 31).

Into the cooling chamber C is injected the cooling $CO_2$ having branched into the balance piston extraction hole 29 positioned in the middle of two balance piston seals 23. The cooling $CO_2$ injected into the cooling chamber C flows between the inner casings 15*a*, 15*b* and the outer casing 14 in directions of dotted-line arrows 63 to 65. The pressure inside the cooling chamber C is lower than the pressure inside the cooling chamber A and higher than the pressure inside the cooling chamber B.

The partition wall 18*b* dividing the cooling chamber C and the cooling chamber D is provided with the partition wall hole 19 being the through hole, so that the cooling $CO_2$ from the cooling chamber C is injected into the cooling chamber D through the partition wall hole 19 (dotted-line arrow 66). The pressure inside the cooling chamber D becomes lower than the pressure inside the cooling chamber C.

The cooling chamber D is a space for cooling the inner casing 15*b* forming the exhaust chamber E, and a part of the labyrinth seal 12*b* is disposed inside the cooling chamber D. In the cooling chamber D, the cooling $CO_2$ at low temperature and at low pressure flows in directions of dotted-line arrows 67 to 70.

The pressure inside the cooling chamber D is kept slightly higher (about 1/10 of pressure inside working $CO_2$ injection pipe 31+ΔP) than the pressure of the exhaust $CO_2$ inside the exhaust chamber E, in order to prevent the exhaust $CO_2$ of the exhaust chamber E from flowing (leaking) from the portion of the wheel space seal 28*b* into the cooling chamber D. Hence, $CO_2$ for cooling or sealing, though in a small amount, flows from the cooling chamber D side into the exhaust chamber E through the wheel space seal 28*b*.

Into the exhaust chamber E flows the exhaust $CO_2$, that is, the working $CO_2$ having been injected from the working $CO_2$ injection pipe 31 and passed through the stationary blades 16 and the rotor blades 13, and the exhaust $CO_2$ is discharged from the $CO_2$ discharge pipe 32. The temperature of the exhaust $CO_2$ of the exhaust chamber E is about slightly more than half (for example, from 500° C. to 1000° C.) of the temperature of the working $CO_2$ injected from the working $CO_2$ injection pipe 31, at the time of rated output. The pressure inside the exhaust chamber E is about 1/10 of the pressure inside the working $CO_2$ injection pipe 31 at the time of rated output. That is, the temperature is medium and the pressure is low inside the exhaust chamber E.

On the other hand, at the time of low load, the pressure inside the working $CO_2$ injection pipe 31 becomes low compared with the pressure at the time of rated output. More specifically, for example, the pressure becomes almost 1/5 of the output at the time of rated output. In such a case, a pressure drop occurs in the front stage of the turbine, but because of lowness of an original pressure, when the pressure is reduced by the pressure drop in the front stage, a pressure drop hardly occurs in the rear stage. In other words, a degree of pressure drop in the rear stage is small compared with that in the front stage. Accordingly, the pressure of the chamber C connected to the middle stage of the turbine becomes low compared with that at the time of rated discharge, making the pressure of the chamber C be almost the same as those of the chamber D and the chamber E on a downstream side in relation to the chamber C. Therefore, the pressure of the chamber C also becomes almost the same as the pressure of the chamber B.

Thus, the pressure difference between the pressure inside the balance piston extraction hole 29 of the balance piston 11*a* and the pressure on the low pressure side (chamber B side) becomes small, to thereby increase the flow of the cooling $CO_2$ flowing from the high pressure side of the balance piston 11*a* into the chamber C through the balance piston extraction hole 29. Meanwhile, the flow amount of the cooling $CO_2$ flowing from the high pressure side (chamber A side) of the balance piston 11*a* to the low pressure side (chamber B side) decreases.

Meanwhile, from between the labyrinth seal 12*a* and the labyrinth seal 12*c* being the gland seals, suction is performed by the gland pump 38. Alternatively, even in a case where the gland pump 38 is in a halt state, because of a pressure difference between the chamber B and the atmosphere, an outflow of the cooling $CO_2$ from the chamber B causes a pressure decrease in the chamber B and the exhaust $CO_2$ might flow back from the $CO_2$ discharge pipe 32 into the exhaust connection piping 35. Because of the high temperature of the exhaust $CO_2$ compared with the cooling $CO_2$, the exhaust connection piping 35 is subjected to be damaged by heat when the exhaust $CO_2$ flows back into the exhaust connection piping 35.

In this embodiment, closing the regulating valve 39 disposed in the exhaust connection piping 35 can prevent a backflow of the exhaust $CO_2$ from the $CO_2$ discharge pipe 32 into the exhaust connection piping 35. In other words, the aforementioned backflow can be prevented by closing the regulating valve 39 at the time of low load and opening the regulating valve when the load comes to have a certain value or more.

Opening and closing of the regulating valve 39 described above is controlled by the control unit 50. The control unit 50 is constituted by a computer and so on, and constitutes the turbine system with the $CO_2$ turbine 5. To the control unit 50, there is inputted a detection signal from the pressure sensor 51 or the like detecting the pressure inside the working $CO_2$ injection pipe 31. Based on the detection signal from the pressure sensor 51, the control unit 50 closes the regulating valve 39 at the time of low load when the pressure is low, and opens the regulating valve 39 when the pressure becomes a high load of a certain value or more. This can prevent the aforementioned backflow of the exhaust $CO_2$ from the $CO_2$ discharge pipe 32 into the exhaust connection piping 35.

Further, it is also possible to regulate a counter thrust force by regulating an opening degree of the regulating valve 39, with the opening degree of the regulating valve 39 at the time of rated output being a medium opening degree. In other words, the counter thrust force can be made larger by raising (opening) the opening degree of the regulating valve 39 from the medium opening degree to thereby lower the pressure on the low pressure side of the balance piston 11*a*. On the other hand, the counter thrust force can be made smaller by lowering (closing) the opening degree of the regulating valve 39 from the medium opening degree to thereby raise the pressure on the low pressure side of the balance piston 11*a*.

The thrust force applied to the thrust bearing can be measured by a thrust load detection sensor disposed in the thrust bearing, for example, the load cell 52. By inputting a detection signal of the load cell 52 to the control unit 50, a largeness of the counter thrust force can be controlled so as to obtain a desired thrust force. In order to balance the thrust force and the counter thrust force stably, preferably $$\text{thrust force} = \text{counter thrust force} + \alpha$$

so that the thrust force may be slightly larger than the counter thrust force.

Further, the pressure on the high pressure side of the balance piston 11*a* is detected by the pressure sensor 53 (high pressure side pressure detection sensor) and the pressure on the low pressure side is detected by the pressure sensor 53 (low pressure side pressure detection sensor), so that the counter thrust force can be found from a difference between detection values thereof. In other words, when the pressure on the high pressure side is indicated as P1, a pressure receiving area on the high pressure side is indicated as A1, the pressure on the low pressure side is indicated as P2 and a pressure receiving area on the low pressure side is indicated as A2, the counter thrust force can be found by $$\text{counter thrust force} = P1 \times A1 - P2 \times A2.$$

Therefore, by inputting the detection signals from two pressure sensors 53 to the control unit 50, the largeness of the counter thrust force can be controlled so as to obtain a desired thrust force.

Figure 3:
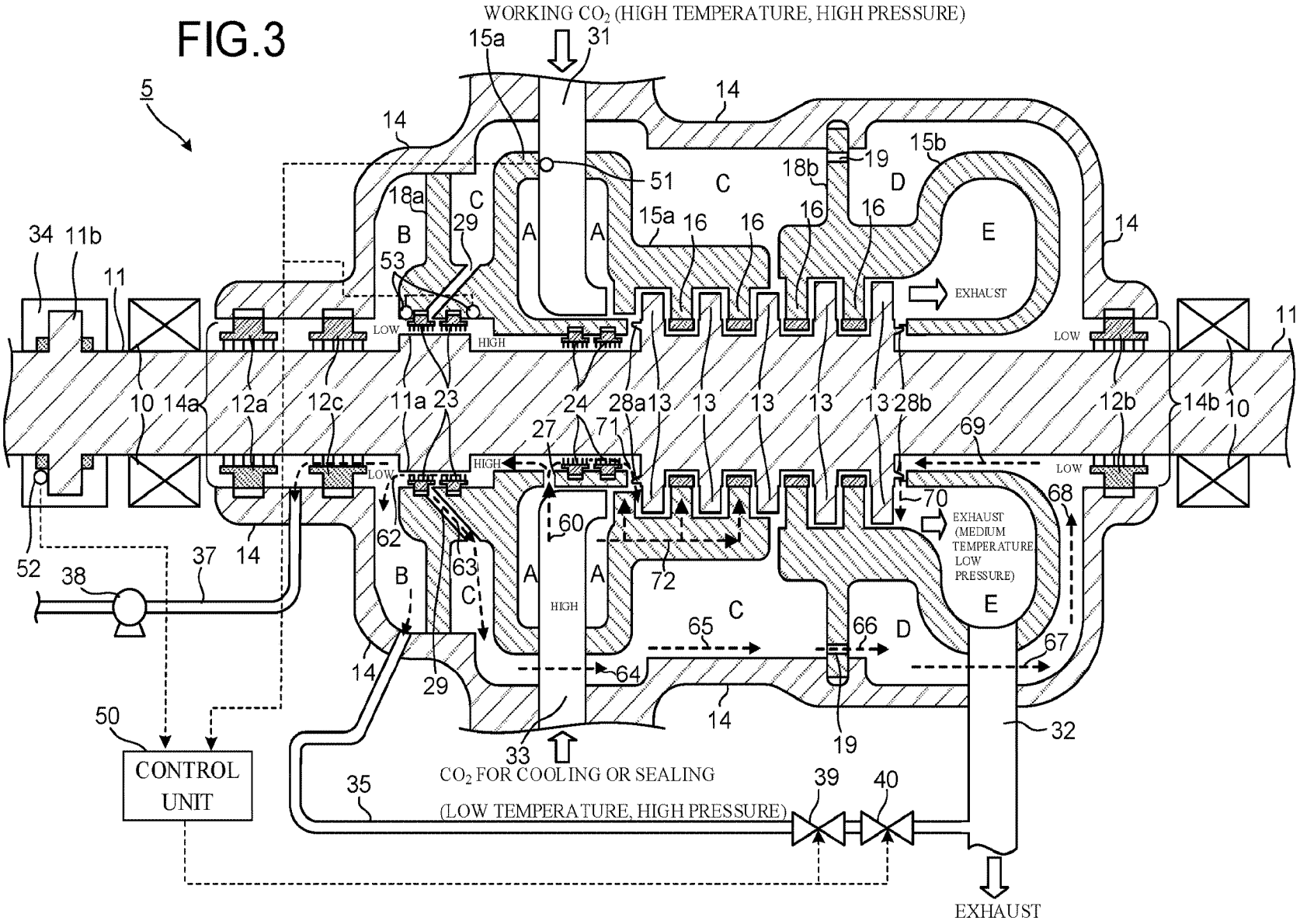
FIG. 3 is a diagram schematically illustrating a configuration of a modification example of the first embodiment.

In order to increase a shut-off property in the exhaust connection piping 35, it is preferable to dispose an opening/closing valve in addition to the regulating valve 39 in the exhaust connection piping 35, as illustrated in FIG. 3. In this case, by closing the opening/closing valve 40 (exhaust connection piping valve mechanism), the exhaust $CO_2$ can be surely prevented from flowing back into the exhaust connection piping 35. Besides, at the time of rated output or the like, by regulating the opening degree of the regulating valve 39 in a state where the opening/closing valve 40 is opened, the largeness of the counter thrust force can be controlled as stated above. Note that in a case where control of the counter thrust force is unnecessary, it is possible to provide only the opening/closing valve 40 without providing the regulating valve 39.

Second Embodiment

Figure 4:
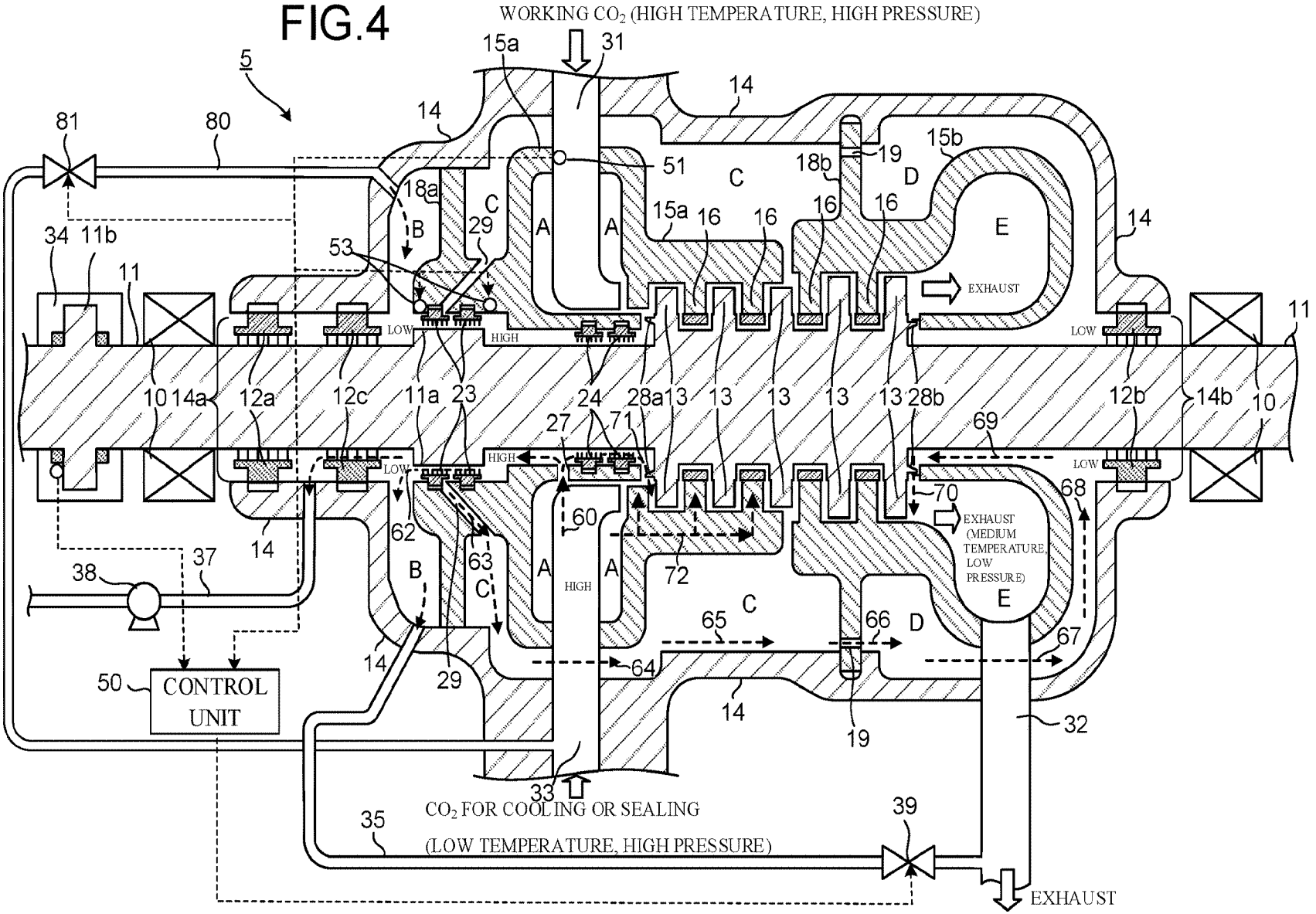
FIG. 4 is a diagram schematically illustrating a configuration of a second embodiment.

Next, a second embodiment will be described with reference to FIG. 4. In the second embodiment, there is disposed a cooling $CO_2$ supply piping 80 (a cooling gas supply piping) to supply cooling $CO_2$ at high pressure from a cooling supply system to a low pressure side (chamber B) of a balance piston 11*a*, and a regulating valve 81 (a cooling gas supply piping valve mechanism) is disposed in the cooling $CO_2$ supply piping 80 as a valve mechanism. The regulating valve 81 is controlled to open and close by a control unit 50. Other parts are constituted similarly to those in the first embodiment illustrated in FIG. 2.

According to the second embodiment of the above configuration, when a regulating valve 39 or an opening/closing valve 40 is closed in order to prevent a backflow of exhaust $CO_2$ into an exhaust connection piping 35 at the time of low load or the like, it is possible to open the regulating valve 81 to thereby supply the cooling $CO_2$ at high pressure from the cooling $CO_2$ supply piping 80 to the low pressure side of the balance piston 11*a*. This enables regulation of a counter thrust force. In this case, when the regulating valve 81 is opened and the cooling $CO_2$ at high pressure is supplied, the pressure on the low pressure side (chamber B) of the balance piston 11*a* rises, decreasing the counter thrust force.

Figure 5:
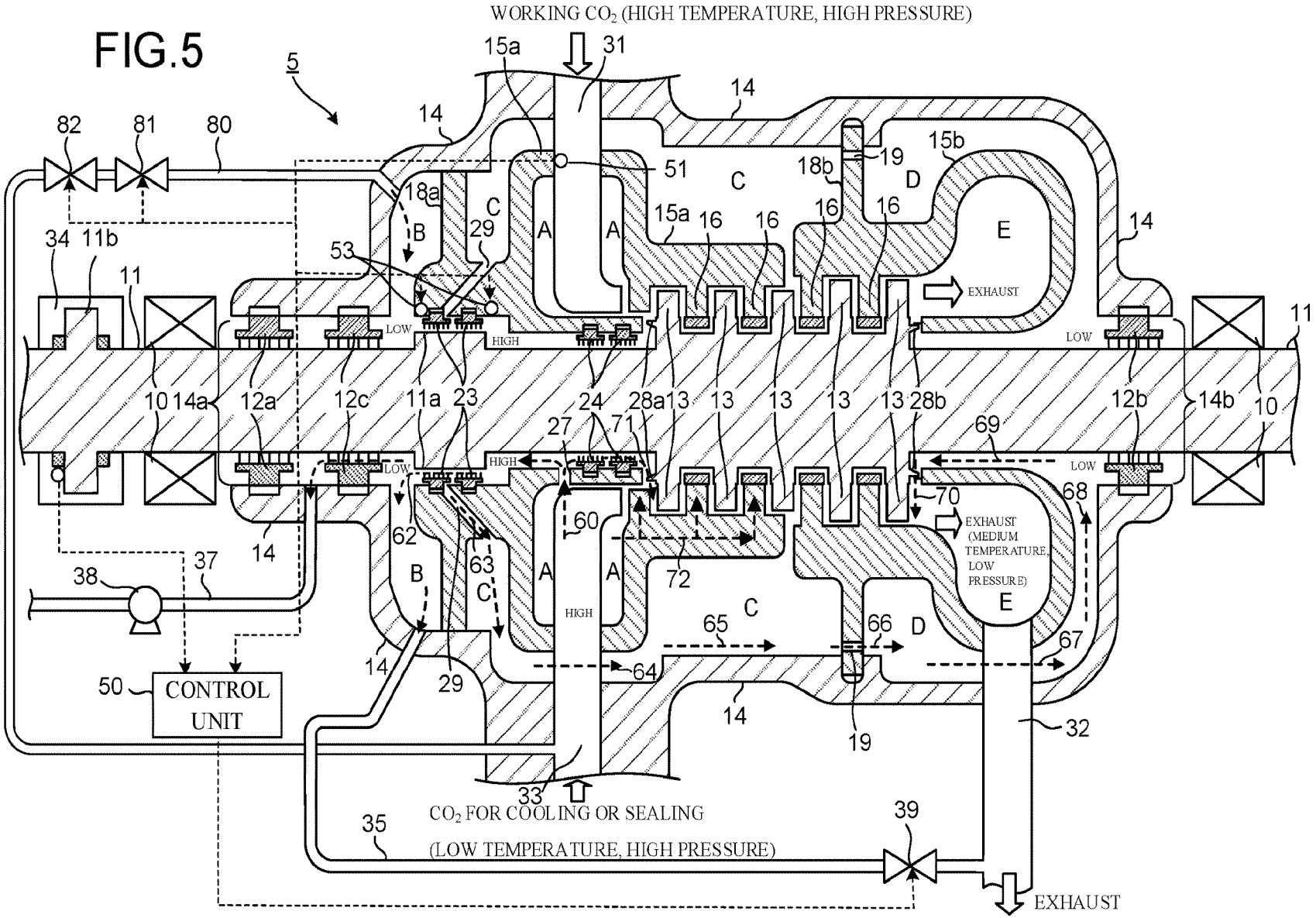
FIG. 5 is a diagram schematically illustrating a configuration of a modification example of the second embodiment.

In order to increase a shut-off property in the cooling $CO_2$ supply piping 80, it is preferable to dispose an opening/closing valve 82 (a cooling gas supply piping valve mechanism) in addition to the regulating valve 81 in the cooling $CO_2$ supply piping 80, as illustrated in FIG. 5. In this case, by closing the opening/closing valve 82, the cooling $CO_2$ supply piping 80 can be surely shut off at the time of rated output or the like. Besides, at the time of low load or the like, by regulating an opening degree of the regulating valve 81 in a state where the opening/closing valve 82 is opened, a largeness of the counter thrust force can be controlled as stated above. The opening/closing valve 82 is controlled to open and close by the control unit 50.

While certain embodiments of the present invention have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

EXPLANATION OF REFERENCE NUMERALS

1 . . . $CO_2$ pump, 2 . . . regenerative heat exchanger, 3 . . . oxygen producer, 4 . . . combustor, 5 . . . $CO_2$ turbine, 6 . . . power generator, 7 . . . cooler, 8 . . . humidity separator, 10 . . . bearing, 11 . . . turbine rotor, 11*a* . . . balance piston, 12*a*, 12*b* . . . mechanical seal (seal mechanism), 13 . . . rotor blade, 14 . . . outer casing, 14*a*, 14*b* . . . through hole, 15*a*, 15*b* . . . inner casing, 16 . . . stationary blade, 18*a*, 18*b* . . . partition wall, 19 . . . partition wall hole, 23 . . . balance piston seal, 24 . . . labyrinth seal, 29 . . . balance piston extraction hole, 31 . . . working $CO_2$ injection pipe (working fluid injection pipe), 32 . . . $CO_2$ discharge pipe (turbine exhaust system), 33 . . . $CO_2$ injection pipe for cooling or sealing (cooling $CO_2$ injection pipe), 35 . . . exhaust connection piping, 39 . . . regulating valve (exhaust connection piping valve mechanism), 40 . . . opening/closing valve (exhaust connection piping valve mechanism), 50 . . . control unit, 51 . . . pressure sensor, 52 . . . load cell (thrust load detection sensor), 53 . . . pressure sensor (high pressure side pressure detection sensor, low pressure side pressure detection sensor), 54 . . . pressure sensor, A to D . . . cooling chamber, E . . . exhaust chamber, 80 . . . cooling $CO_2$ supply piping (cooling gas supply piping), 81 . . . regulating valve (cooling gas supply piping valve mechanism), 82 . . . opening/closing valve (cooling gas supply piping valve mechanism)

What is claimed is:

1. A turbine comprising:

a casing;

a turbine rotor disposed to penetrate the casing;

a plurality of turbine stages disposed in the casing and provided along a shaft direction of the turbine rotor;

a working fluid injection pipe allowing a working medium to be injected into the casing and to be distributed from the front stage toward the rear stage of the turbine stages, thereby rotating the turbine rotor;

a balance piston disposed in the turbine rotor;

a plurality of balance piston seals disposed in the casing in a manner to face the balance piston;

a balance piston extraction hole allowing extraction from between the plurality of balance piston seals to the middle stage of the turbine stages;

an exhaust connection piping connecting a low pressure side of the balance piston to a turbine exhaust system;

an exhaust connection piping valve mechanism provided in the exhaust connection piping;

a plurality of seal mechanisms provided between the low pressure side of the balance piston and the atmosphere; and an exhaust piping allowing exhaust from between the plurality of seal mechanisms.

2. The turbine according to claim 1, wherein the exhaust connection piping valve mechanism comprises a regulating valve and an opening/closing valve.

3. The turbine according to claim 1, comprising:

a cooling gas supply piping which supplies cooling gas from a cooling supply system for supplying the cooling gas into the casing to the low pressure side of the balance piston; and a cooling gas supply piping valve mechanism provided in the cooling gas supply piping.

4. The turbine according to claim 3, wherein the cooling gas supply piping valve mechanism comprises a regulating valve and an opening/closing valve.

5. A turbine system comprising the turbine according to claim 1, comprising a control unit controlling the exhaust connection piping valve mechanism to open and close.

6. The turbine system according to claim 5, wherein the control unit regulates an opening degree of the regulating valve constituting the exhaust connection piping valve mechanism to thereby increase and decrease a largeness of a counter thrust force generated in the balance piston.

7. The turbine system according to claim 6, wherein the control unit regulates the opening degree of the regulating valve based on a detection signal from a thrust load detection sensor which is provided in a thrust bearing and detects a turbine thrust load.

8. The turbine system according to claim 6, wherein the control unit regulates the opening degree of the regulating valve based on detection signals from a high pressure side pressure detection sensor detecting a pressure of a high pressure side of the balance piston and from a low pressure side pressure detection sensor detecting a pressure of a low pressure side of the balance piston.

* * * * *